US006199226B1

(12) United States Patent
Steadman

(10) Patent No.: US 6,199,226 B1
(45) Date of Patent: Mar. 13, 2001

(54) BATH LIFT

(75) Inventor: William David Steadman, Stuart, FL (US)

(73) Assignee: Silver Crown Associates Limited (GB)

( * ) Notice: Subject to any disclaimer, the term of this patent is extended or adjusted under 35 U.S.C. 154(b) by 0 days.

(21) Appl. No.: 09/485,773

(22) PCT Filed: Aug. 14, 1998

(86) PCT No.: PCT/GB98/02444

§ 371 Date: Feb. 15, 2000

§ 102(e) Date: Feb. 15, 2000

(87) PCT Pub. No.: WO99/08643

PCT Pub. Date: Feb. 25, 1999

Related U.S. Application Data

(60) Provisional application No. 60/055,788, filed on Aug. 15, 1997.

(51) Int. Cl.[7] ..... A47K 3/12

(52) U.S. Cl. ..... 4/565.1; 4/560.1

(58) Field of Search ..... 4/560.1, 561.1, 4/562.1, 563.1, 564.1, 565.1, 566.1

(56) References Cited

U.S. PATENT DOCUMENTS

| | | | | |
|---|---|---|---|---|
| 2,045,110 | | 6/1936 | Spiess | 4/562.1 |
| 2,123,398 | * | 7/1938 | Bowers | 4/562.1 |
| 3,317,928 | | 5/1967 | Root | 4/561.1 |
| 3,581,316 | | 6/1971 | Petersen | 4/566.1 |
| 5,185,892 | | 2/1993 | Mitchell | 4/578.1 |

FOREIGN PATENT DOCUMENTS 0 486 215 A1 5/1992 (EP) .

* cited by examiner

*Primary Examiner*—Robert M. Fetsuga
(74) *Attorney, Agent, or Firm*—Watts, Hoffmann, Fisher & Heinke, Co., L.P.A.

(57) ABSTRACT

A bath lift comprising a U shaped frame (14) locatable on the bath. Each side limb (15) of the frame (14) mounts a respective roller (32) between which a flexible band (38) extends. The rollers (32) are interconnected to simultaneously feed the band (38) out or in whereby to raise or lower a person sitting thereon into a bath.

15 Claims, 6 Drawing Sheets

80
82
83
81
84
86
88
90
92
94
104
128
130
15
38
32

BATH LIFT

This application is a 371 of PCT/GB98/02444 Filing date Aug. 14, 1998 which claims benefit of U.S. Ser. No. 60/055/788 Filing date Aug. 15, 1997.

This invention concerns bathlifts and particularly but not exclusively bath lifts for lowering or raising a person to or from a seated position on the bottom of a bath.

A number of bath lifts are available to lower and raise a person to an from a seated position on the bottom of a bath. Such lifts often do not provide security or at least a feeling of security, to a person thereon, or sufficient support to the person whilst they are being raised or lowered.

According to the present invention there is provided a bath lift, the lift comprising an elongate flexible band extendable across a bath from one side to the other such that a person can sit on the band, and means for selectively simultaneously feeding the band in or out from both sides of the bath such that the band is movable between a first position extending taughtly between the bath sides, and a second position such that the band is pressed by a person sitting thereon onto the bottom of the bath so that the person is sitting in the bath.

The lift may comprise two rollers which are locatable one on either side of the bath. The rollers may be interconnected to simultaneously rotate at the same speed, and desirably in opposite directions. The lift may comprise a motor, and gearing connecting with the rollers.

The lift may comprise a substantially U-shape frame with the base of the U locatable at an end of the bath, and the side limbs extendable along respective sides of the bath. A shaft driveable by the motor, may extend along the base of the U. The shaft preferably connects with the rollers via gearing, and perhaps also via further shafts extending partway along the side limbs of the frame.

The shaft may be threaded, and non-rotatable threaded members may be provided on the shaft engageable with an appropriately located switch or switches to automatically turn the motor off when the band reaches the first and/or second position. The positioning of the or each switch is preferably adjustable, and the or each switch may be mounted on a, or on a respective, threaded elongate member such that rotation of the member causes movement of one or more switches.

The lift may be removably locatable on a bath. Alternatively, means may be provided for mounting the lift on or adjacent to a bath. The mounting means may be such that the lift is selectively movable between an in-use condition extending over a bath, and an out-of-use condition clear of the bath. The mounting means may be arranged such that in the out-of-use condition the lift extends generally upwardly away from the bath.

The lift preferably comprises a back rest against which a person sitting on the band can lean. The back rest may be padded. The back rest may be pivotally mounted on the lift, or removably mounted thereon.

A support member may be provided engagable between the frame and the bottom of the bath. The support member may extend respectively from adjacent the free ends of the side limbs of the frame to the bottom of the bath, and the support member may comprise a generally U shape member with the base of the U engagable with the bottom of the bath. The support member preferably braces the free ends of the side limbs apart. The support member may be mounted on the frame by a ratchet arrangement such that it is restrainably held in a required position relative thereto.

The support member and/or back rest may be pivotally mounted on the frame to be able to lie substantially parallel thereto in the out-of-use condition.

The frame may be arranged such that at least one of the side limbs of the frame in the in-use condition lies on or alongside the side of a bath. Supporting members may be provided on one or both of the side limbs engageable with the top of the side of the bath, and the supporting members may be pivotally mounted to the or each side limb. Alternatively the supporting members may comprise adjustable feet.

The lift may be adjustable in size to be usable with different size baths. The support member may be adjustable in height. Any of the support member, back rest, base of the frame, or shaft extending along the frame base, may be adjustable across the width of the lift.

Electric control means may be provided to permit a user to control the feeding out or in of the band. The control means may be selectively locatable on either side of the lift as is required, and may comprise a plug in module.

A set member may be provided locatable on the band for a person to sit on. The seat member may be substantially rigid or semi rigid. The side edges of the seat member may be flexible or pivotable to accommodate tapering side walls of a bath. The side edges may comprise one or more strips of substantially rigid or semi rigid material joined to the main part of the seat member by a web or webs.

The lift may be arranged to automatically stop rotation of the rollers upon a voltage change across the motor being detected.

An embodiment of the present invention will now be described by way of example only with reference to the accompanying drawings, in which.

Figure 1:
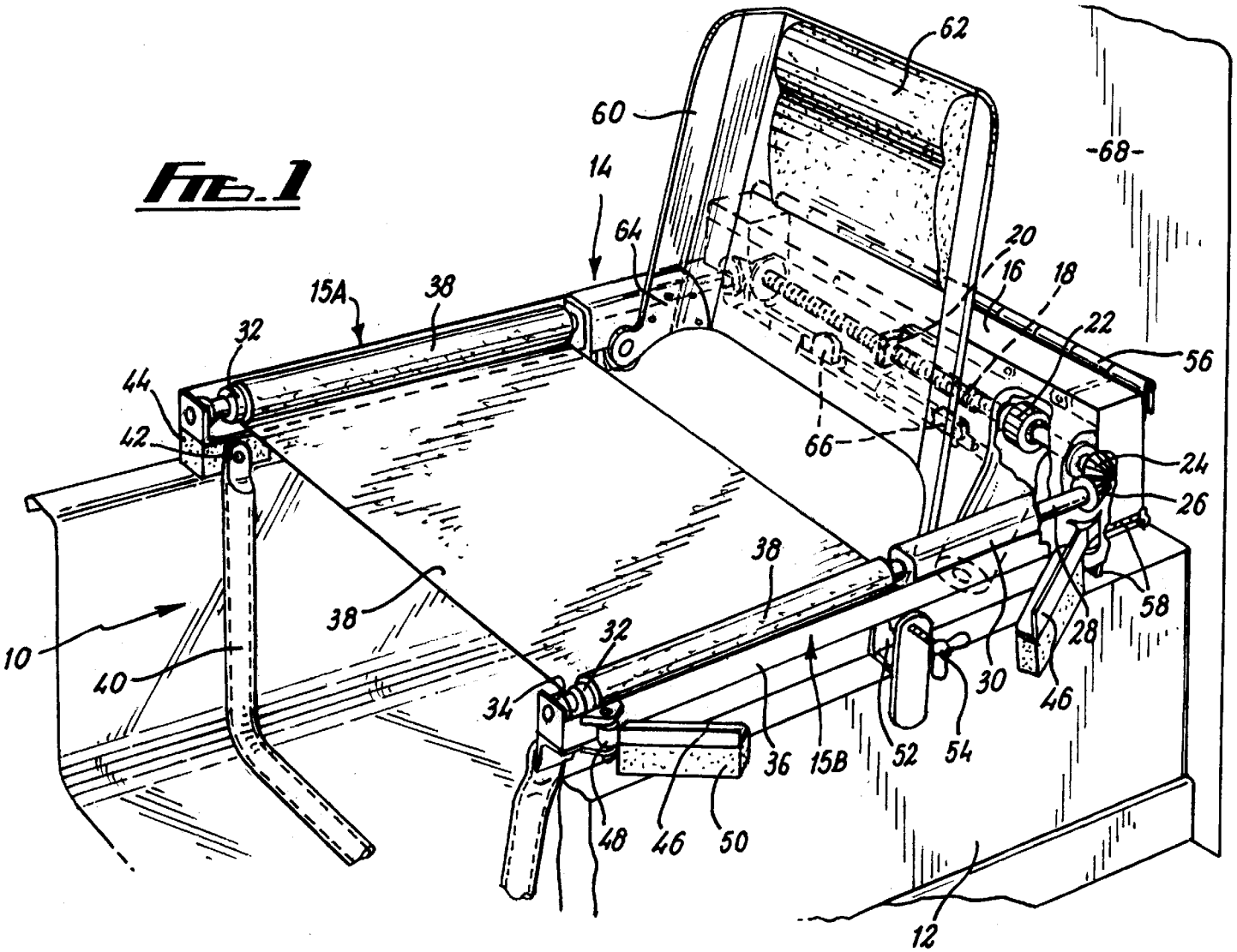
FIG. 1 is a diagrammatic perspective view of a bath lift according to the invention in an in-use position.
Figure 2:
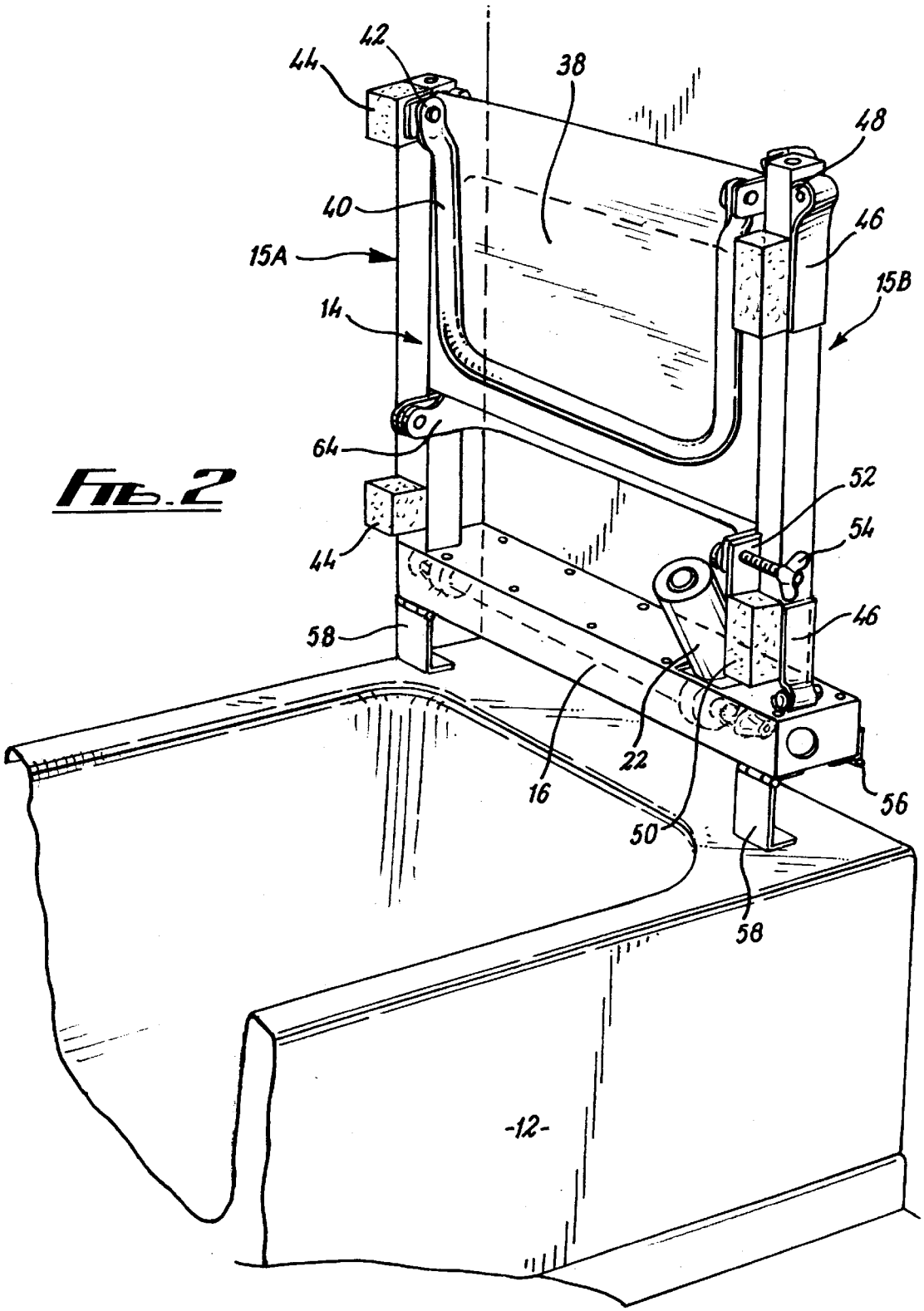
FIG. 2 is a similar view but with the bath lift in an out-of-use position.

FIGS. 1 and 2 of the drawings show a bath lift 10 suitable for lowering a person in a sitting position level with the height of a bath 12, to a position sitting on the bottom of the bath 12, and back up again. The lift 10 comprises a U-shaped frame 14. The base 16 of the frame 14 is of box section and rotatably locates a threaded shaft 18. A non-rotatable threaded abutment member 20 is mounted on the shaft 18 to be movable therealong by virtue of rotation of the shaft. A low voltage electric motor 22 is mounted on the base 16, driveably engagable with the shaft 18.

Bevelled gears 24 are provided on each end of the shaft 18 and drivingly engageable with further bevelled gears 26. Each of the gears 26 is provided on the end of a further shaft 28 which extends within a respective casing 30 which forms part of the side limbs 15A and 15B of the U-shaped frame 14. The free ends of the further shafts 28 each mount a respective roller 32. The rollers 32 extend to the free end of the side limbs 15A and 15B and are rotatably mounted at the free ends of the limbs 15A and 15B in bearings 34. The portion 36 of the side limbs 15 of the frame 14 which locates the rollers 32 is in the form of inwardly and upwardly facing L-shaped section, closed off at each end.

A flexible band 38 extends between the rollers 32, around which the free ends of the band 38 are rolled. Removable covers (not shown) are provided extendable over the top of the rollers 32. A U-shaped support member 40 extends between the portions 36 towards their free end, and is pivotally mounted thereto by downwardly extending brackets 42. The member 40 braces the portions 36 apart and provides support against the bottom of the bath. Rubber pads (not shown) or other protective members may be provided on the base of the member 40 to protect the bath from scratching or other damage.

On the furthest side limb 15A of the frame 14 as shown in FIG. 1, resilient pads 44 are provided beneath the free end of the portion 36 and also beneath the casing 30. Two support arms 46 are provided on the other side limb 15B in positions corresponding to the pads 44. The arms 46 are mounted to the side limb 15B by brackets 48 to be pivotal about substantially vertical axes when in the condition shown in FIG. 1. Further resilient pads 50 are provided on the underside of the support arms 46.

A clamping member 52 in the form of a plate is mounted by a threaded bolt 54 to the underside of the casing 30 on the near side arm of the frame 14 as shown in FIG. 1. A mounting hinge 56 is provided extending along the length of the base 16 on the upper corner thereof furthest from the bath 12, as shown in FIG. 1. Two support feet 58 with an L-shaped cross-section are pivotally mounted to the base 16, each adjacent a respective end thereof, at the lower edge furthest from the bath 12 as shown in FIG. 1.

A back rest 60 with padding 62 is pivotally mounted between the side arms of the frame 14, by respective brackets 64 between the band 38 and base 16. The brackets 64 are such that the back rest 60 can readily be removed. Two micro switches 66 are mounted in the base 16 to be engageable with the abutment 20. The positioning of the micro switches 66 can be varied as required, for a purpose hereinafter to be indicated.

FIG. 1 shows the lift 10 installed for use with the bath 12. The base 16 is mounted to a wall 68 at one end of the bath 12. The base 16 is mounted by the hinge 50 and at a height such that with the feet 50 pivoted to rest against the underside of the base 16, the feet 58 engage on the top of the end of the bath 12. The side limbs of the frame 14 extend along the sides of the bath 12. The side limb 15A rests on top of the side of the bath 12 with the pads 44 engaging therewith. The side limb 15B lies just inside the side of the bath 12, with the support arms 46 pointing outwardly and the pads 50 thereon engaging with the top of the respective side of the bath. The plate 52 is positioned using the bolt 54 against the inside of the bath 12.

In use, with the lift 10 in the condition shown in FIG. 1, a person can sit on the band 38. The motor 22 can then be actuated by any suitable switch such as a hand-held waterproof switch. Actuation of the motor 22 causes rotation of the shaft 18 and hence rollers 32, to feed out the band 38 such that the person will be lowered into the bath 12. If required the person can rest against the back rest 60. When the band 38 reaches the bottom of the bath 12, if the motor 22 is not switched off by the user, the abutment 20 will contact a respective one of the micro switches 66 and automatically turn the motor 22 off.

Once bathing has been finished, the lift 10 can be operated in a similar manner but with the motor 22 operating in an opposite direction such that the band 38 is wound on to the rollers 32 to raise a person. Again, if the person does not switch off the motor 22, the abutment 20 will contact and actuate the other respective micro switch 66 to turn off the motor 22. During installation the positioning of the micro switches 66 can be set correspondingly for a particular location and with regard to the weight of a user. For instance for a heavier person the band 38 will require to be tauter in the raised position. The switches 66 may be mounted on one or more threaded bars (not shown) to enable positioning by rotation of the bar. Handles (also not shown), which may be removable, may be provided on the or each threaded bar.

If the lift 10 is not required for use, it can be folded to the out-of-use position shown in FIG. 2 as follows. The clamping member 52 is released and the support arms 46 folded in. The lift 10 can then be pivoted upwardly about the hinge 56. When extending vertically upwards, the support fee 58 can be positioned to support the base 16 as shown. The back rest 60 is folded against the top surface of the band 38, with the support member 40 folded against the underside of the band 38.

Figure 3:
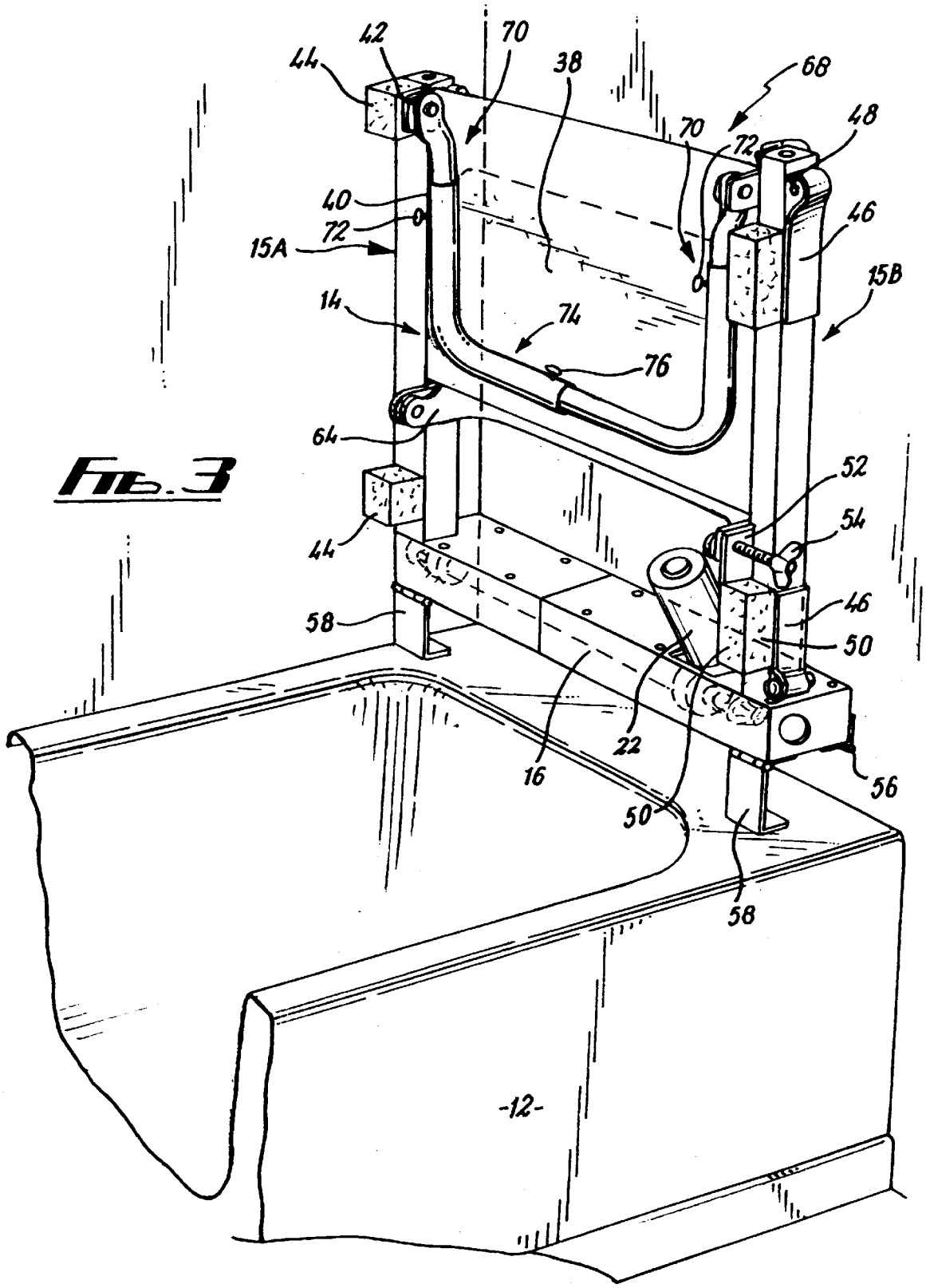
FIG. 3 is a similar view to FIG. 2 of a further bath lift according to the invention.

It is to be realized that baths come in many different shapes and sizes. In some instances there would not be sufficient exposed side of the bath for the limb 15A to rest thereon. In such an instance on that side of the bath the weight of the lift would be borne entirely by the support member 40. Further clamping members would then probably be provided on that side of the frame. The support arms 46 are usable with small differences in bath widths. However, in some instances it may be required to provide a lift which is adjustable in size. Such a lift 68 is shown in FIG. 3. The lift 68 is as per the lift 10 except as indicated below. The length of the side limbs of the support member 40 are adjustable by virtue of a telescopic arrangement 70 with locking screws 72. The width of the base of the member 40 is adjustable by virtue of a further telescopic arrangement 74 with a locking screw 76. The base 16 is also telescopic and the shaft 18 therein (not shown in FIG. 3) is also adjustable in length by a similar arrangement. The back rest 60 can either be omitted or arranged to be adjustable in width by virtue of one side telescoping out of the other.

FIGS. 4–10 show a still further bath lift 80 which is generally similar to the lift except as outlined below. The lift 80 can be placed on and off a bath and has four adjustable feet 82 comprising rubber based pads 81 mounted on threaded shafts 83. The back rest 84 is removably mounted on the back of the U shaped frame by strips of fleece and hook fastener 86.

Figures 4, 5, 6, 7:
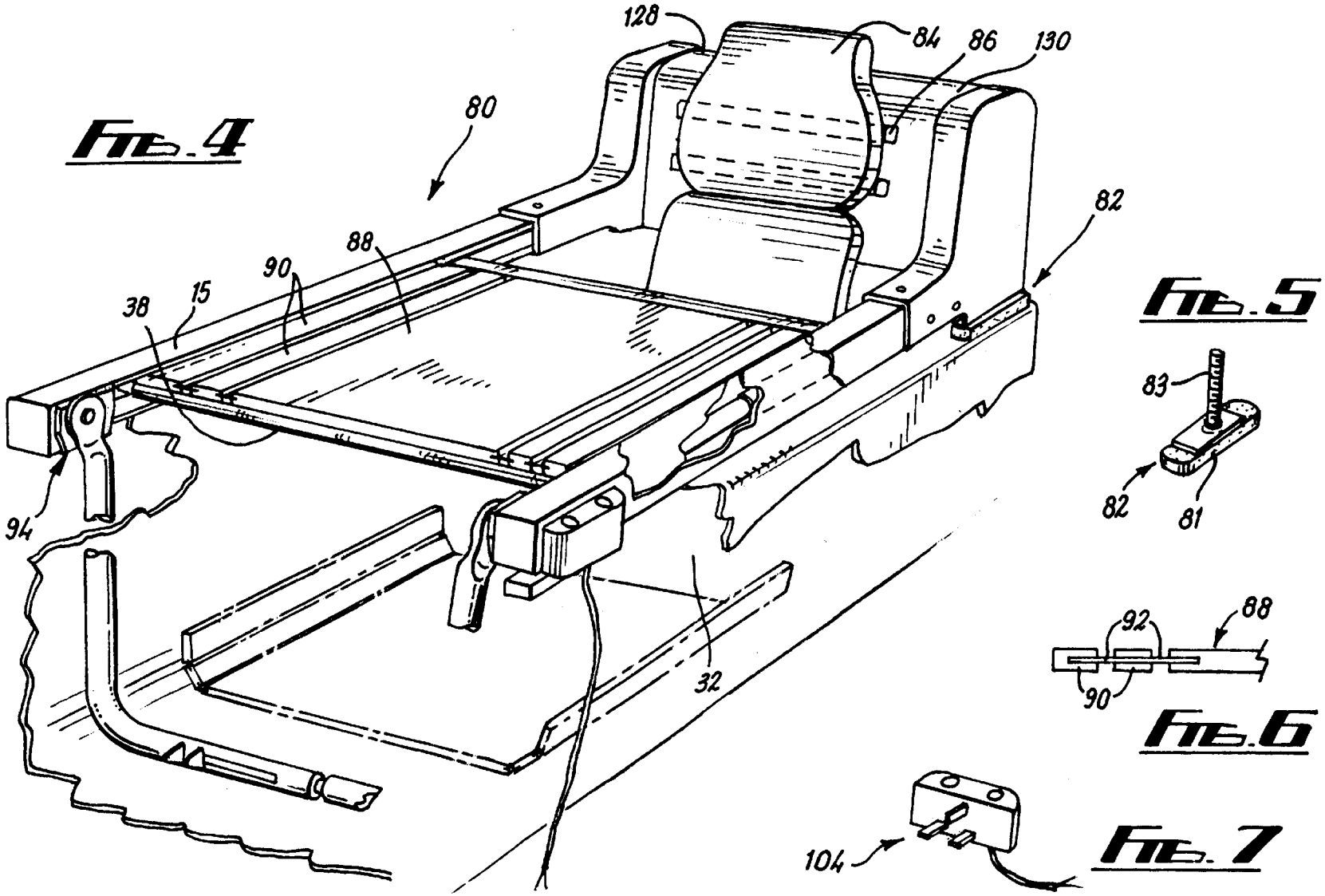
FIG. 4 is a similar view to FIG. 1 of a still further bath lift according to the invention.
FIGS. 5–8 are perspective diagrammatic views of components of the still further bath lift.

The band 38 emerges from the rollers 32 at the top thereof to cross the bath, rather than the bottom as in the lift 10. The arrangement of the lift 80 in this respect is generally found to be preferable. A seating board 88 is mounted on the band 38 such that a person sits on the board 88. The board 88 is made of laminated plastics material. The side edges of the board 88 each comprise two strips 90 of similar material joined to the main part of the board 88 by a web 92 which extends therethrough (FIG. 6). This allows the board to be used with baths which have tapering side walls, as the strips 90 can pivot upwards by virtue of the web 92.

The support member 40 is mounted to the side limbs 14 by ratchet arrangements 94 (FIGS. 9 and 10) which permits the member 40 to be restrainably held in a required position thereby providing better support on the bottom of the bath as well as bracing the limbs 15 apart. Each ratchet arrangement 94 comprises a plurality of teeth 96 on a plate member 98 provided on the side limb 15, and a sprung finger 100 mounted on the support member and selectively engageable with the teeth 96. The finger 100 is provided on the free end of a cranked handle 102 to permit manual release of the finger 100 from the teeth 96.

Electric control means are provided for the lift 80. The control means comprise a plug in unit 104 (FIG. 7) which can be plugged in on either side limb 15 as is required. The lift 80 is arranged such that the motor 106 automatically switches off upon a voltage change thereacross being detached. Such a change occurs when the band 38 becomes slack at the bottom of the bath and the motor has less work to do, or when the motor is strained as the band 38 becomes taught.

Figure 8:
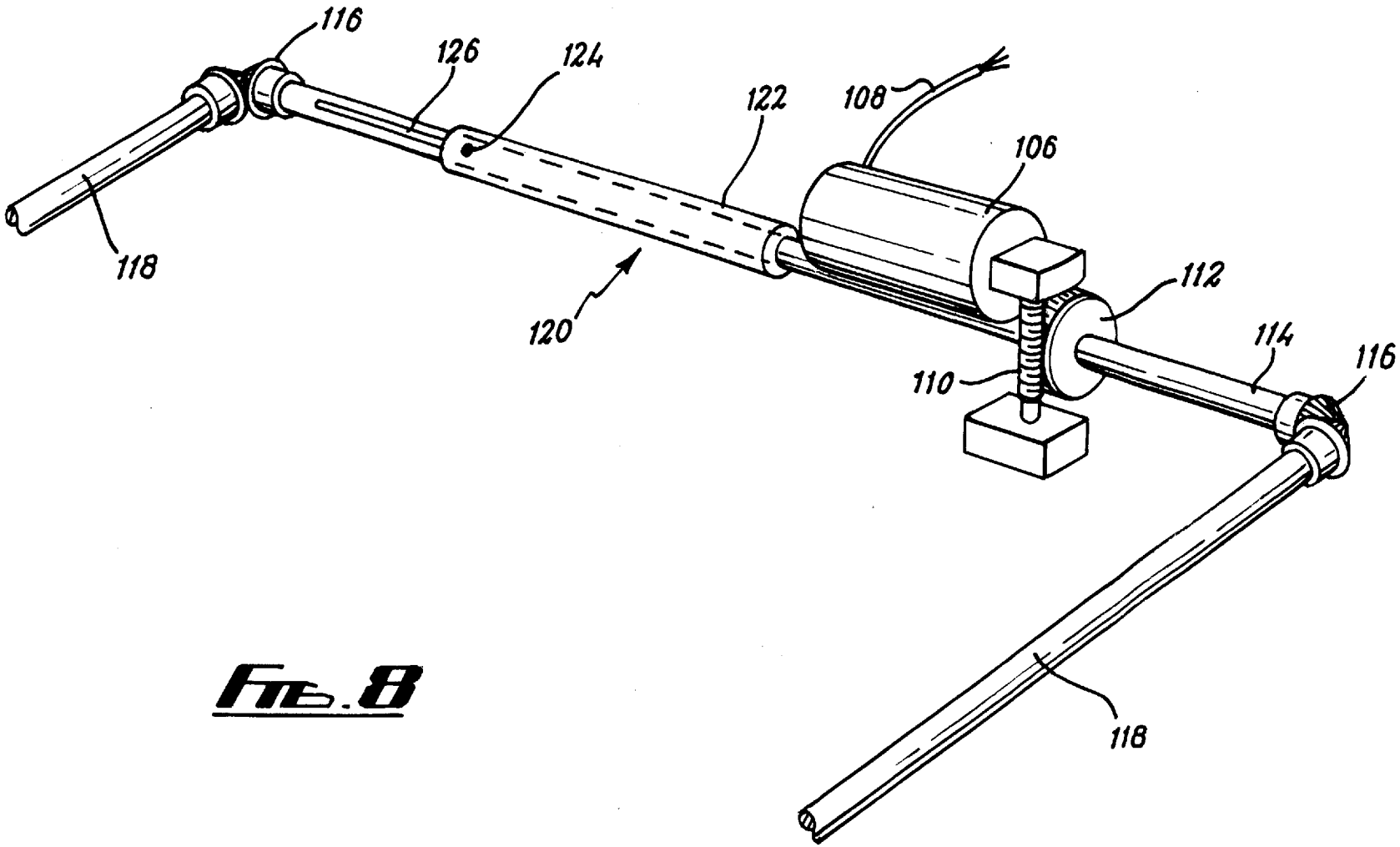
Figure 9:
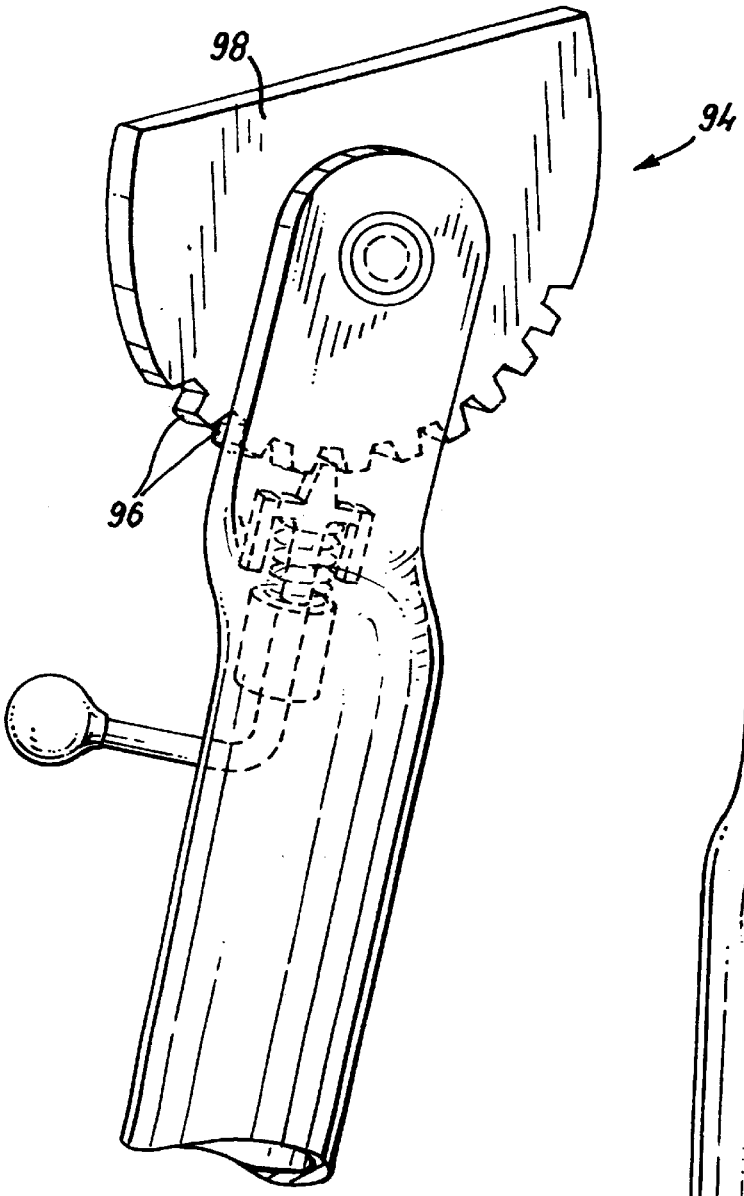
FIGS. 9 and 10 are diagrammatic perspective views from opposite sides of part of the lift of FIG. 4.
Figure 10:
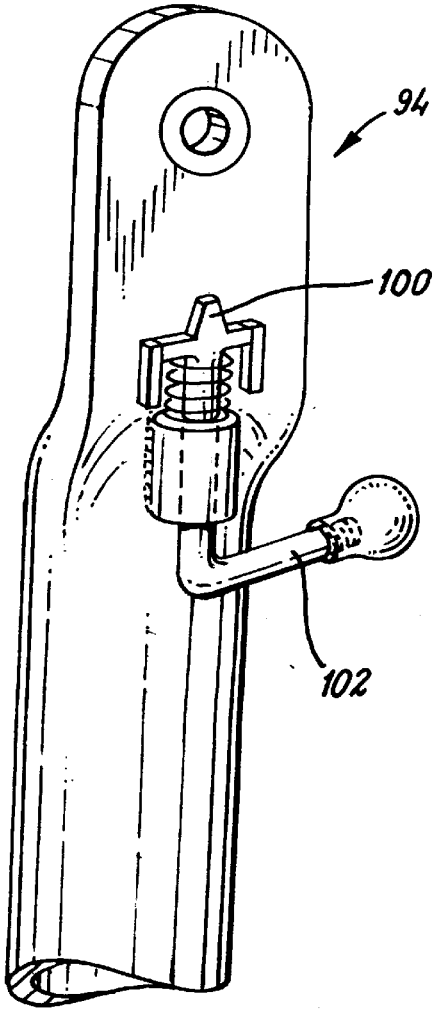

FIG. 8 shows the general roller drive arrangement for the lift 80. In this instance the motor 106 is parallel to the base of the U shaped frame 14. Leads 108 connects to the control means 104. The motor 106 connects by a reduction gear 110 to a worm wheel 112 on a transverse shaft 114. This connects at one side by bevelled gears 116 to a shaft 118, the opposite end of which serves as a one of the rollers. The connection to the other shaft 118 is again through bevelled gears 116 and incorporates a size adjustment arrangement 120. The arrangement 120 incorporates a split in the shaft 114 which is filled by a larger hollow shaft 122 which overlaps the ends of the shaft 114. The shaft 122 is adjustable lockable on the part of the shaft 114 which extends from the bevelled gears 116, by a screw 124 engageable in a keyway 126 formed on the shaft 114.

As well as the drive shaft 114 from the motor 106 being adjustable in width the casing 30 covering this is provided in two slidably connected covers 128, 130 to allow the width to be varied.

There are thus provided bath lifts with a number of advantageous features. The provision of the band being fed out or fed in simultaneously from both sides of the bath, provides for a stable arrangement such that the person does not have to walk to their position on the band or lean during raising or lowering. The back rest provides support and an increased security and feeling of security for persons on the lift. The pivotal arrangement of the lift means that it can readily be moved to and from an in-use condition, and otherwise takes up very little space.

Various other modifications may be made without departing from the scope of the invention. For instance, the lift may be arranged such that it can be removably mountable on a bath, and further clamping members would probably be provided. With the above described folding arrangement clamping members may not be required. The rollers could be driven other than as shown in the specific embodiment. The motor may be located elsewhere, for example on a one of the side limbs of the frame. Different means could be provided for automatically stopping the lift when the respective upper and lower positions are reached. For instance, one or more trigger bars may be provided with which the band is engageable when the end positions are reached.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A bath lift (10,80), the lift (10,80) comprising an elongate flexible band (38) extendible across a bath (12) from one side to the other such that a person can sit on the band (38), means (32) for selectively simultaneously feeding the band (38) in or out from both sides of the bath (12) such that the band (38) is movable between a first position extending tautly between the bath sides, and a second position such that the band (38) is pressed by a person sitting thereon onto the bottom of the bath (12) so that the person is sitting in the bath (12), a substantially U-shape frame (14) with the base (16) of the U locatable at an end of the bath (12), and the side limbs (15A,15B) extendible along respective sides of the bath (12), characterised in that a support member (40) is provided engageable between the frame (14) and the bottom of the bath (12).

2. A bath lift (10,80) according to claim 1, characterised in that the lift (10,80) comprises two rollers (32) which are locatable one on either side of the bath (12), the rollers (32) preferably being interconnected to simultaneously rotate at the same speed, and desirably to simultaneously rotate in opposite directions.

3. A bath lift (10,80) according to claim 2, characterised in that the lift (10,80) comprises a motor (22,106), and gearing (24,26,116) connecting with the rollers (32).

4. A bath lift (10,80) according to claim 3, characterised in that a shaft (18,114) driveable by the motor (22,106), extends along the base (16) of the U, the shaft (18,114) preferably connecting with the rollers (32) via gearing (24,26,116), and desirably also via further shafts (28,118) extending partway along the side limbs (15A,15B) of the frame (14).

5. A bath lift (10,80) according to claim 4, characterised in that the shaft (18) is threaded, and non-rotatable threaded members (20) are provided on the shaft engageable with an appropriately located switch or switches (56) to automatically turn the motor (22,106) off when the band (38) reaches the first and/or second position, the positioning of the or each switch (66) being preferably adjustable, and desirably the or each switch (66) is mounted on a, or on a respective, threaded elongate member such that rotation of the member causes movement of one or more switches (66).

6. A bath lift (10,80) according to claim 3, characterised in that the lift (10,80) is arranged to automatically stop rotation of the rollers (32) upon a voltage change across the motor (22,106) bring detected.

7. A bath lift (10,80) according to claim 1, characterised in that the lift (10,80) is removably locatable on a bath (12).

8. A bath lift (10,80) according to claim 1, characterised in that means (56) may be provided for mounting the lift on or adjacent to a bath (12), the mounting means (56) may be such that the lift (10,80) is selectively movable between an in-use condition extending over a bath (12), and an out-of-use condition clear of the bath (12), and desirably the mounting means (56) may be arranged such that in the out-of-use condition the lift (10,80) extends generally upwardly away from the bath (12).

9. A bath lift (10,80) according to claim 1, characterised in that the lift (10,80) comprises a back rest (60,84) against which a person sitting on the band (38) can lean, the back rest (60,84) may be padded (62), may be pivotally mounted on the lift (10,80) and/or may be removably mounted on the lift (10,80).

10. A bath lift (10,80) according to claim 1, characterised in that the support member (40) comprises a generally U shape member with the base of the U engagable with the bottom of the bath (12), the support member (40) may extend respectively from adjacent the free ends (36) of the side limbs (15) of the frame (14) to the bottom of the bath (12), and the support member (40) preferably braces the free ends (36) of the side limbs apart (15).

11. A bath lift (10,80) according to claim 1, characterised in that the frame (14) is arranged such that at leas tone of the side limbs (15) of the frame (14) in the in-use condition lies on or alongside the side of a bath (12).

12. A bath lift (10,80) according to claim 1, characterised in that supporting members (46,82) are provided on one or both of the side limbs (15) engageable with the top of the side of the bath (12), the supporting members (46) may be pivotally mounted to the or each side limb (15) and/or may comprise adjustable feet (82).

13. A bath lift (10,80) according to claim 1, characterised in that the lift (10,80) is adjustable in size to be usable with different size baths (12), and any of the support member (40), back rest (60,84), base (16) of the frame (14), or shaft (18,114) extending along the frame base (16) may be adjustable across the width of the lift (10,80).

14. A bath lift (10,80) according to claim 1, characterised in that electric control means are provided to permit a user to control the feeding out or in of the band (38), the control means may be selectively locatable on either side of the lift (10,80) as is required and/or may comprise a plug in module (104).

15. A bath lift (10,80) according to claim 1, characterised in that a seat member (88) is provided locatable on the band (38) for a person to sit on, the seat member (88) may be substantially rigid or semi rigid, the side edges of the seat member (88) may be flexible or pivotable to accommodate tapering side walls of a bath (12) and may comprise one or more strips (90) of substantially rigid or semi rigid material jointed to the main part of the seat member (88) by a web or webs (92).

* * * * *